US007275308B2

(12) United States Patent
Kim et al.

(10) Patent No.: US 7,275,308 B2
(45) Date of Patent: Oct. 2, 2007

(54) METHOD FOR MANUFACTURING A MONOLITHIC INK-JET PRINTHEAD

(75) Inventors: Hyeon-cheol Kim, Seoul (KR); Yong-soo Oh, Seongnam (KR); Keon Kuk, Yongin (KR); Kwang-joon Yoon, Suwon (KR); Jae-sik Min, Suwon (KR); Sang-hyun Lee, Seoul (KR); Chang-seung Lee, Seoul (KR); Seog Soon Baek, Suwon (KR); Sang-wook Lee, Seongnam (KR); Jong-cheol Shin, Suwon (KR)

(73) Assignee: Samsung Electronics Co., Ltd., Suwon, Kyungki-do (KR)

( * ) Notice: Subject to any disclaimer, the term of this patent is extended or adjusted under 35 U.S.C. 154(b) by 470 days.

(21) Appl. No.: 10/740,573

(22) Filed: Dec. 22, 2003

(65) Prior Publication Data

US 2004/0130597 A1 Jul. 8, 2004

Related U.S. Application Data

(62) Division of application No. 10/278,991, filed on Oct. 24, 2002, now Pat. No. 6,692,112.

(30) Foreign Application Priority Data

Oct. 25, 2001 (KR) ..... 2001-66021

(51) Int. Cl.
*H05B 3/00* (2006.01)

(52) U.S. Cl. ..... 29/611; 29/617; 29/619; 29/621; 29/890.1; 347/47; 347/56; 347/59; 347/63; 347/65

(58) Field of Classification Search ..... 29/611, 29/617, 619, 621, 890.1; 347/47, 56, 59, 347/63, 65

See application file for complete search history.

(56) References Cited

U.S. PATENT DOCUMENTS 4,339,762 A 7/1982 Shirato et al.

(Continued)

FOREIGN PATENT DOCUMENTS

AU 657 720 8/1992

(Continued)

OTHER PUBLICATIONS

Note: JP'037=AU'720.

(Continued)

*Primary Examiner*—A. Dexter Tugbang
*Assistant Examiner*—Tim Phan
(74) *Attorney, Agent, or Firm*—Lee & Morse, P.C.

(57) ABSTRACT

A method for manufacturing the same, wherein the monolithic ink-jet printhead includes a manifold for supplying ink, an ink chamber having a hemispheric shape, and an ink channel formed monolithically on a substrate; a silicon oxide layer, in which a nozzle for ejecting ink is centrally formed in the ink chamber, is deposited on the substrate; a heater having a ring shape is formed on the silicon oxide layer to surround the nozzle; a MOS integrated circuit is mounted on the substrate to drive the heater and includes a MOSFET and electrodes connected to the heater. The silicon oxide layer, the heater, and the MOS integrated circuit are formed monolithically on the substrate. Additionally, a DLC coating layer having a high hydrophobic property and high durability is formed on an external surface of the printhead.

28 Claims, 14 Drawing Sheets

U.S. PATENT DOCUMENTS

| | | | | |
|---|---|---|---|---|
| 4,847,630 | A | 7/1989 | Bhaskar et al. | |
| 4,882,595 | A | 11/1989 | Trueba et al. | |
| 4,947,192 | A | 8/1990 | Hawkins et al. | |
| 5,635,966 | A | 6/1997 | Keefe et al. | |
| 5,760,804 | A | 6/1998 | Heinzl et al. | |
| 5,825,385 | A | 10/1998 | Silverbrook | |
| 5,841,452 | A * | 11/1998 | Silverbrook | 347/47 |
| 5,850,241 | A | 12/1998 | Silverbrook | |
| 6,062,679 | A | 5/2000 | Meyer et al. | |
| 6,273,557 | B1 * | 8/2001 | Milligan et al. | 347/65 |

FOREIGN PATENT DOCUMENTS

| | | |
|---|---|---|
| EP | 0 317 171 A2 | 5/1989 |
| JP | 6-040037 | 2/1994 |

OTHER PUBLICATIONS

Tseng et al, A Novel Microinjector with Virgual Chamber Neck, pp. 57-62, (1998) 0-7803-4412-X/98IEEE.

* cited by examiner

METHOD FOR MANUFACTURING A MONOLITHIC INK-JET PRINTHEAD

CROSS REFERENCE TO RELATED APPLICATION

This is a divisional application based on U.S. application Ser. No. 10/278,991, filed on Oct. 24, 2002, now U.S. Pat. No. 6,692,112, the entire contents of which is hereby incorporated by reference.

BACKGROUND OF THE INVENTION

1. Field of the Invention

The present invention relates to an ink-jet printhead. More particularly, the present invention relates to a monolithic ink-jet printhead having a hemispheric ink chamber and working in a bubble-jet mode, and a method for manufacturing the same.

2. Description of the Related Art

In general, ink-jet printheads eject small ink droplets for printing at a desired position on a paper and print out images having predetermined colors. Ink ejection methods for ink-jet printers include an electro-thermal transducer method (bubble-jet type) for ejecting an ink droplet by generating bubbles in ink using a heat source, and an electro-mechanical transducer method for ejecting an ink droplet according to a variation in the volume of ink caused by the deformation of a piezoelectric body.

In a bubble-jet type ink ejection mechanism, as mentioned above, when power is applied to a heater comprised of a resistance heating element, ink adjacent to the heater is rapidly heated to about 300° C. Heating the ink generates bubbles, which grow and swell, and thus apply pressure in the ink chamber filled with the ink. As a result, ink adjacent to a nozzle is ejected from the ink chamber through the nozzle.

There are multiple factors and parameters to consider in making an ink-jet printhead having an ink ejecting unit in a bubble-jet mode. First, it should be simple to manufacture, have a low manufacturing cost, and be capable of being mass-produced. Second, in order to produce high quality color images, the formation of undesirable satellite ink droplets that usually accompany an ejected main ink droplet must be avoided during the printing process. Third, cross-talk between adjacent nozzles, from which ink is not ejected, must be avoided, when ink is ejected from one nozzle, or when an ink chamber is refilled with ink after ink is ejected. For this purpose, ink back flow, i.e., when ink flows in a direction opposite to the direction in which ink is ejected, should be prevented. Fourth, for high-speed printing, the refilling period after ink is ejected should be as short a period of time as possible to increase the printing speed. That is, the driving frequency of the printhead should be high.

The above requirements, however, tend to conflict with one another. Furthermore, the performance of an ink-jet printhead is closely related to and affected by the structure and design, e.g., the relative sizes of ink chamber, ink passage, and heater, etc., as well as by the formation and expansion shape of the bubbles.

FIGS. 1A and 1B illustrate a conventional bubble-jet type ink-jet printhead according to the prior art. FIG. 1A is an exploded perspective view illustrating the structure of a conventional ink ejecting unit. FIG. 1B illustrates a cross-sectional view of the ejection of an ink droplet from the conventional bubble-jet type ink-jet printhead illustrated in FIG. 1A.

The conventional bubble-jet type ink-jet printhead shown in FIGS. 1A and 1B includes a substrate 10, a barrier wall 12 formed on the substrate 10 for forming an ink chamber 13 to be filled with ink 19, a heater 14 installed in the ink chamber 13, and a nozzle plate 11 in which nozzles 16, from which an ink droplet 19' is ejected, are formed. The ink chamber 13 is filled with ink 19 through an ink channel 15. The nozzle 16, which is in flow communication with the ink chamber 13, is filled with ink 19 due to a capillary action. In the above structure, if current is supplied to the heater 14, the heater 14 generates heat. The heat forms a bubble 18 in the ink 19 in the ink chamber 13. The bubble 18 swells applies pressure to the ink 19 in the ink chamber 13, and the ink droplet 19' is pushed out through the nozzle 16. Next, the ink 19 is absorbed through the ink channel 15, and the ink chamber 13 is refilled with the ink 19.

In the conventional printhead, however, the ink channel 15 is connected to a side of the ink chamber 13, and a width of the ink channel 15 is large. Therefore, back flow of the ink 19 easily occurs when swelling of the bubble 18 appears. In order to manufacture a printhead having the above structure, the nozzle plate 11 and the substrate 10 should be separately manufactured and bonded to each other, resulting in a complicated manufacturing process and often causing misalignment when the nozzle plate 11 is bonded to the substrate 10.

FIG. 2 illustrates a cross-sectional view of the structure of another conventional ink ejecting unit according to the prior art.

In the conventional ink-jet printhead shown in FIG. 2, ink 29 passes over the edges of a substrate 22 through an ink channel 25 formed in a print cartridge body 20 from an ink reservoir and flows into an ink chamber 23. When the heater 24 generates heat, bubbles 28 formed in the ink chamber 23 swell, and thus the ink 29 is ejected through nozzles 26 in a droplet form.

Even in the printhead having the above structure, however, a polymer tape 21, in which the nozzles 26 are formed, should be bonded to a top end of the print cartridge body 20 using an adhesive seal 31, and the substrate 22, on which the heater 24 is mounted, is installed in the print cartridge body 20. Then the substrate should be bonded to the polymer tape 21 by placing a thin adhesive layer 32 between the polymer tape 21 and the substrate 22. As with the first conventional printhead manufacturing process, the above printhead manufacturing process is complicated, and misalignment may occur in the bonding process of the elements.

SUMMARY OF THE INVENTION

In an effort to solve the above problems, it is a feature of an embodiment of the present invention to provide a bubble-jet type ink-jet printhead having a hemispheric ink chamber, in which the elements of the ink-jet printhead and a MOS integrated circuit are formed monolithically on a substrate, and a method for manufacturing the same.

Accordingly, to provide the above feature, according to one aspect of the present invention, there is provided a monolithic ink-jet printhead including a substrate on which a manifold for supplying ink, an ink chamber filled with ink to be ejected, the ink chamber having a hemispheric shape, and an ink channel for supplying ink to the ink chamber from the manifold are formed monolithically, a silicon oxide layer, in which a nozzle for ejecting ink is formed in a position corresponding to a center of the ink chamber, the silicon oxide layer being deposited on the substrate, a heater formed on the silicon oxide layer to surround the nozzle, and a MOS integrated circuit mounted on the substrate to drive the heater, the MOS integrated circuit including a MOSFET and electrodes connected to the heater. The silicon oxide layer, the heater, and the MOS integrated circuit are formed monolithically on the substrate.

It is preferable that a coating layer formed of diamond-like carbon (DLC) is formed on an external surface of the printhead. The DLC coating layer has high hydrophobic property and durability.

Preferably, the MOSFET includes a gate, formed on a gate oxide layer using the silicon oxide layer as the gate oxide layer, and source and drain regions, formed under the silicon oxide layer. It is also preferable that the heater and the gate of the MOSFET are formed of the same material. It is also preferable that a field oxide layer thicker than the silicon oxide layer is formed as an insulating layer around the MOSFET.

Further, it is also preferable that a first passivation layer is formed on the heater and on the MOSFET, and a second passivation layer is formed on the electrodes. Also preferably, the first passivation layer includes a silicon nitride layer and the second passivation layer includes tetraethylorthosilicate (TEOS) oxide layer.

Preferably, a nozzle guide extended in a direction of the depth of the ink chamber from the edges of the nozzle is formed on an upper portion of the ink chamber.

The manifold is preferably formed on the bottom surface of the substrate, and the ink channel is formed to be in flow communication with the manifold on the bottom of the ink chamber.

In a printhead according to the present invention, all of the above manufacturing and alignment requirements may be satisfied. Additionally, the elements of the printhead and a MOS integrated circuit are formed monolithically on the substrate, thereby achieving a more compact printhead.

In addition, to provide the above feature, according to another aspect of the present invention, there is provided a method for manufacturing a monolithic ink-jet printhead. The method includes preparing a silicon substrate, forming a first silicon oxide layer by oxidizing the surface of the substrate, forming on the substrate a MOS integrated circuit including a MOSFET for driving the heater and electrodes connected to the heater, forming a heater on a second silicon oxide layer, forming inside the heater a nozzle for ejecting ink by etching the second silicon oxide layer to a diameter smaller than that of the heater, forming a manifold for supplying ink by etching a bottom surface of the substrate, forming an ink chamber having a diameter larger than that of the heater and having a hemispheric shape by etching the substrate exposed by the nozzle, and forming an ink channel for connecting the ink chamber to the manifold by etching the bottom of the ink chamber through the nozzle.

Here, it is preferable that after forming the ink channel, the method further includes coating a coating layer formed of diamond-like carbon (DLC) on an external surface of the printhead.

Preferably, forming the MOS integrated circuit includes depositing a silicon nitride layer on the first silicon oxide layer, etching a portion of the first silicon oxide layer and the silicon nitride layer, forming a field oxide layer thicker than the first silicon oxide layer around a region in which the MOSFET is to be formed, removing the first silicon oxide layer and the silicon nitride layer, forming a second silicon oxide layer on the substrate, forming a gate of the MOSFET on a gate oxide layer using the second silicon oxide layer as the gate oxide layer, forming source and drain regions of the MOSFET under the second silicon oxide layer, and forming electrodes for electrically connecting the heater to the MOSFET.

Preferably, the gate and the heater are simultaneously formed of the same material, or the gate is formed of impurity-doped polysilicon, and the heater is formed of an alloy of tantalum and aluminum.

Preferably, a first passivation layer is formed on the heater and on the MOSFET, and the electrodes are formed on the first passivation layer, and a second passivation layer is formed on the electrodes. A boro-phosphorous-silicate glass (BPSG) layer may be coated on the first passivation layer to planarize the surface of the printhead.

Forming an ink chamber may be preformed by isotropically etching the substrate exposed by the nozzle, or by isotropically etching the substrate after anisotropically etching the substrate exposed by the nozzle, to a predetermined depth. Forming the ink chamber may also include forming a hole having a predetermined depth by anisotropically etching the substrate exposed by the nozzle, depositing a predetermined material layer to a predetermined thickness on the entire surface of the anisotropically-etched substrate, exposing a bottom of the hole by anisotropically etching the material layer and simultaneously forming a nozzle guide, which is formed of the material layer, on the sidewall of the hole, and forming the ink chamber by isotropically etching the substrate exposed to the bottom of the hole.

In the method for manufacturing a monolithic ink-jet printhead according to the present invention, the elements of an ink-jet printhead and a MOS integrated circuit may be formed monolithically on a substrate, thereby facilitating mass-production of the printhead.

BRIEF DESCRIPTION OF THE DRAWINGS

The above features and advantages of the present invention will become readily apparent to those of ordinary skill in the art by describing in detail preferred embodiments thereof with reference to the attached drawings in which.

DETAILED DESCRIPTION OF THE INVENTION

Figure 1A:
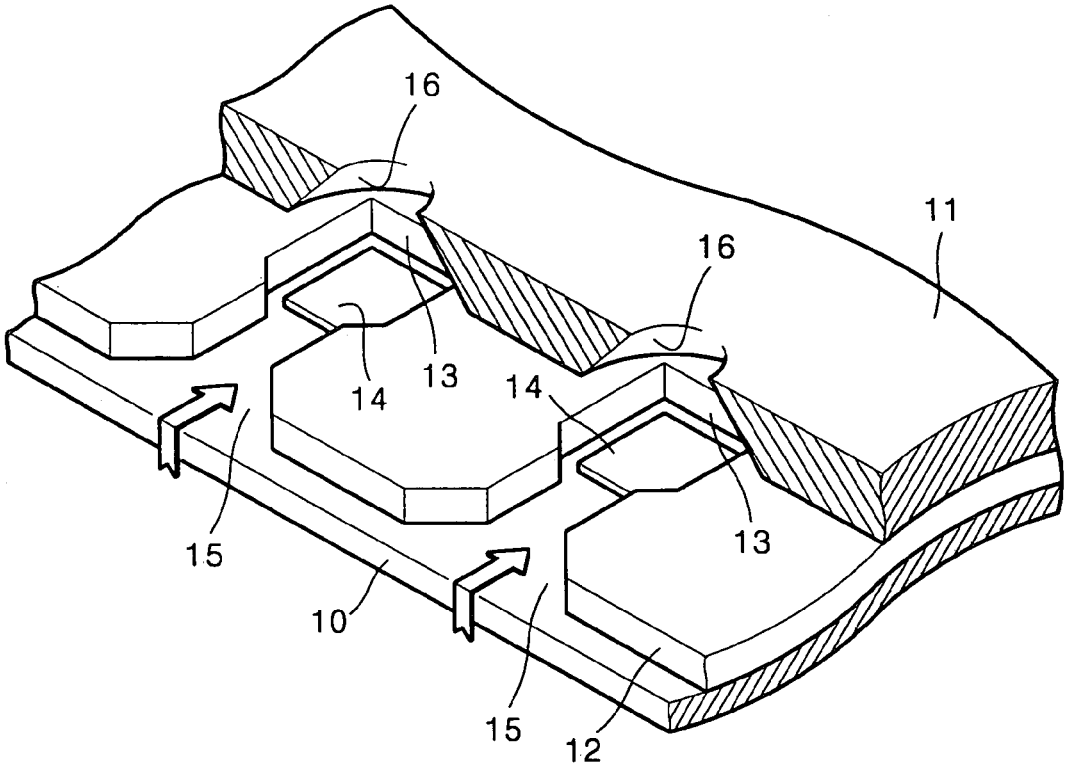
FIG. 1A (PRIOR ART)
FIGS. 1A and 1B illustrate exploded perspective views showing the structure of a conventional bubble-jet type ink-jet printhead, and a cross-sectional view illustrating the step of ejecting an ink droplet therefrom, respectively.
Figure 1B:
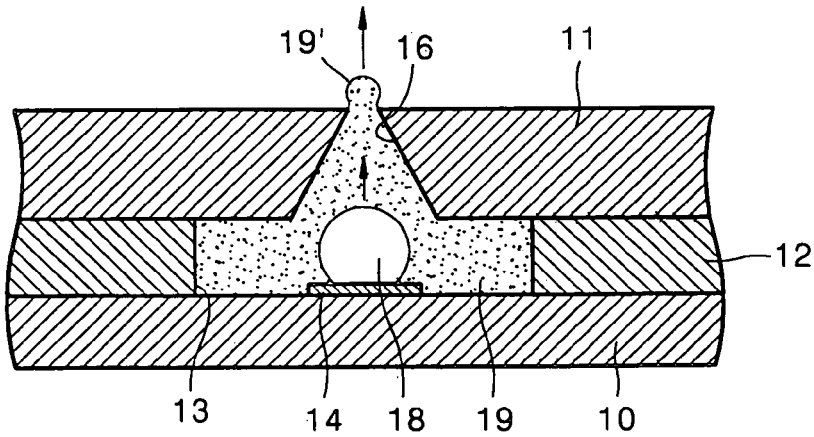
FIG. 1B (PRIOR ART)
Figure 2:
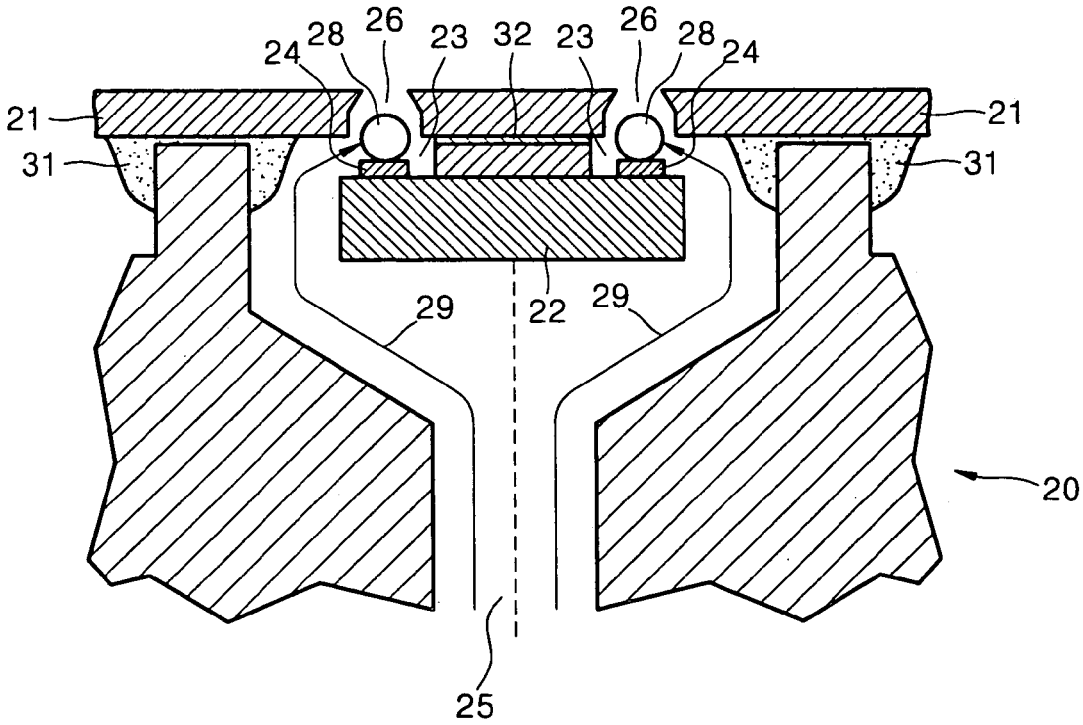
FIG. 2 (PRIOR ART)
FIG. 2 illustrates a cross-sectional view of the structure of another conventional bubble-jet type ink-jet printhead.

Korean Patent Application No. 2001-66021, filed Oct. 25, 2001, and entitled: "Monolithic Ink-Jet Printhead and Method for Manufacturing the Same," is incorporated by reference herein in its entirety.

Hereinafter, the present invention will be described in detail by describing preferred embodiments of the invention with reference to the accompanying drawings. Like reference numerals refer to like elements throughout the drawings. In the drawings, the shape and thickness of an element may be exaggerated for clarity and convenience. Further, it will be understood that when a layer is referred to as being on another layer or "on" a substrate, it may be directly on the other layer or on the substrate, or intervening layers may also be present.

Figure 3:
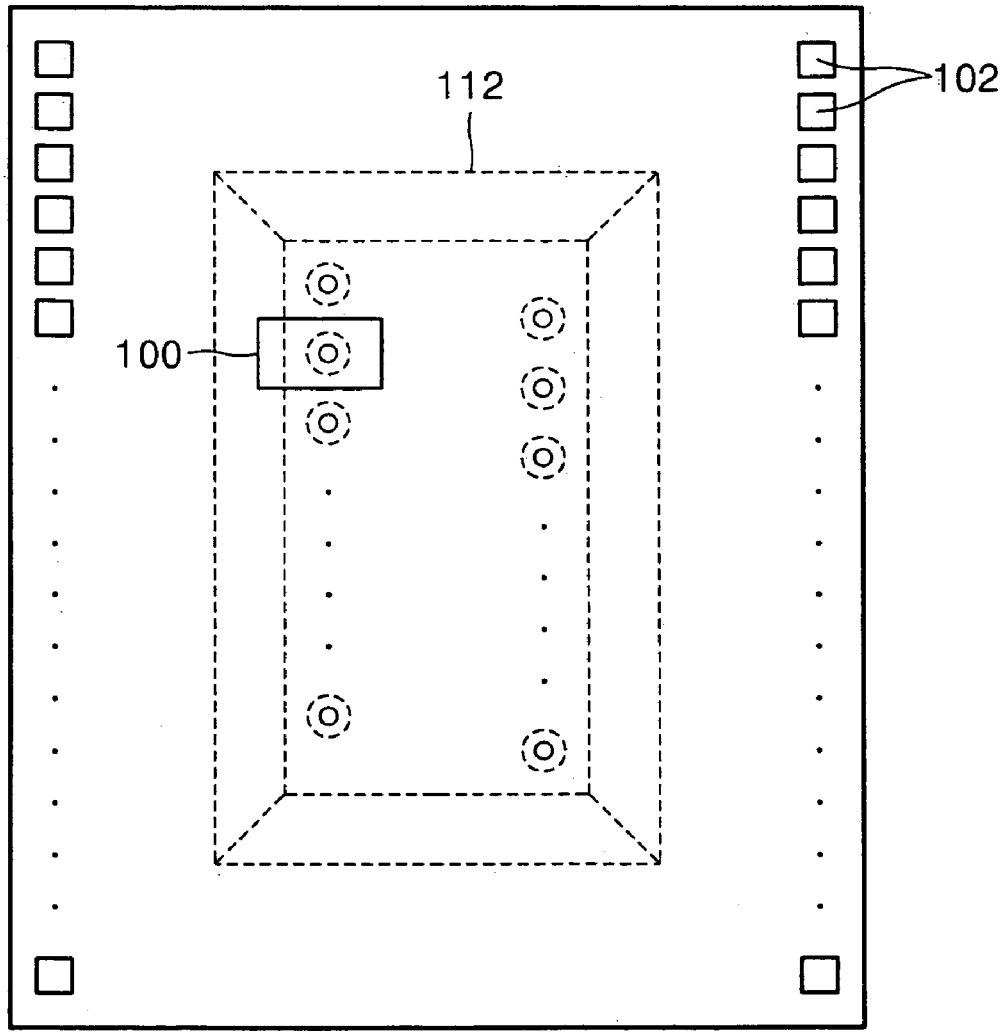
FIG. 3 illustrates a schematic plan view of an ink-jet printhead according to an embodiment of the present invention.

FIG. 3 illustrates a schematic plan view of an ink-jet printhead according to the present invention. In the ink-jet printhead according to the present invention shown in FIG. 3, ink ejecting units 100 are alternately disposed on an ink supply manifold 112 indicated by a dotted line, and bonding pads 102, which are to be electrically connected to each ink ejecting unit 100 through a MOS integrated circuit and to which wires are to be bonded, are disposed on both sides. One ink supply manifold 112 may be formed in each column of the ink ejecting unit 100. In the drawing, the ink ejecting units 100 are disposed in two columns, but may be disposed in one column, or in three or more columns so as to improve resolution. Although a printhead using only one color ink is shown in the drawing, for color printing, three or four groups of ink ejecting units according to colors may be disposed.

Figure 4:
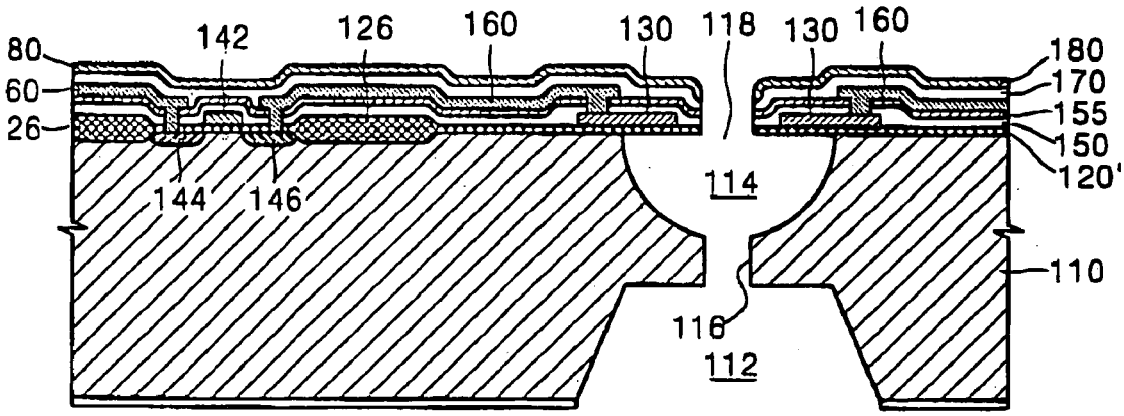
FIG. 4 illustrates a cross-sectional view of the vertical structure of an ink ejecting unit according to a first embodiment of the present invention.

FIG. 4 illustrates a cross-sectional view of the vertical structure of an ink ejecting unit according to a first embodiment of the present invention. As shown in FIG. 4, an ink chamber 114 filled with ink is formed on the surface of a substrate 110 of the ink ejecting unit, the ink supply manifold 112 for supplying ink to the ink chamber 114 is formed on a bottom surface of the substrate 110, and an ink channel 111 for connecting the ink chamber 114 to the ink supply manifold 112 is centrally formed in the bottom of the ink chamber 114. Preferably, the ink chamber 114 is formed in a nearly hemispheric shape. Preferably, the substrate 110 is formed of silicon, which is widely used in manufacturing integrated circuits. More preferably, the diameter of the ink channel 116 is smaller than that of a nozzle 118 to prevent the back flow of ink.

A silicon oxide layer 120', in which the nozzle 118 is formed, is deposited on the surface of the substrate 110, thereby forming an upper wall of the ink chamber 114.

A heater 130 for forming bubbles is formed on the silicon oxide layer 120' to surround the nozzle 118. Preferably, the heater 130 has a ring shape and is formed of a resistance heating element, such as impurity-doped polysilicon or an alloy of tantalum and aluminum.

In general, a driving circuit is employed to apply pulse current to a heater of a printhead; in the prior art, a bipolar circuit is mainly used as a driving circuit. However, the structure of the bipolar circuit becomes complicated as more heaters are used, which leads to an increasingly complicated and expensive manufacturing process. Thus, recently, a MOS integrated circuit which can be manufactured at cheaper cost has been proposed as a driving circuit for a heater.

As a result, according to the present invention, a MOS integrated circuit is employed as a driving circuit for driving the heater 130 by applying pulse current to the heater 130. In particular, the MOS integrated circuit is formed monolithically on the substrate 110 with the heater 130. In the above structure, a more compact printhead may be manufactured by a simplified process as compared to the prior art.

The MOS integrated circuit includes a MOSFET and electrodes 160. The MOSFET includes a gate 142 formed on the silicon oxide layer 120' using the silicon oxide layer 120' as a gate oxide layer, a source region 144 and a drain region 146, which are formed under the silicon oxide layer 120'. The electrodes 160 are formed to be connected between the MOSFET and the heater 130 and between the MOSFET and the bonding pads (102 of FIG. 3) and are usually formed of metal, such as aluminum or an aluminum alloy. A field oxide layer 126 for insulating the MOSFET is formed around the MOSFET to be thicker than the silicon oxide layer 120'.

A first passivation layer 150 may be formed on the gate 142 of the MOSFET and on the heater 130 to provide protection. Preferably, a silicon nitride layer may be used as the first passivation layer 150. Preferably, a boro-phosphorous-silicate glass (BPSG) layer 155 is coated on the first passivation layer 150 to planarize the surface 110.

Figure 5:
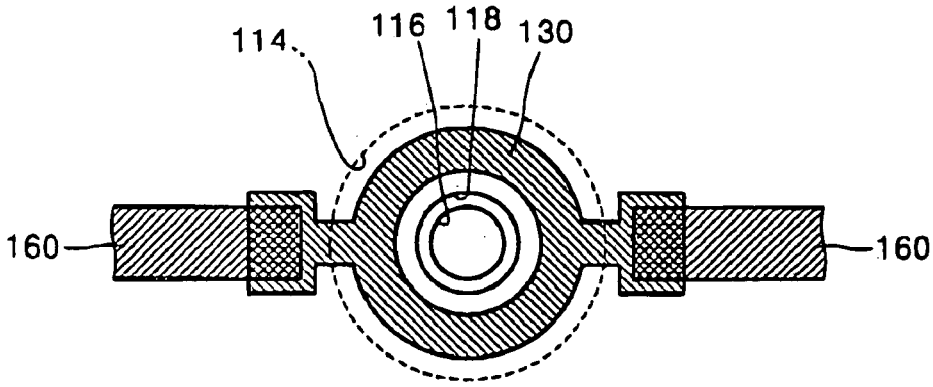
FIG. 5 illustrates a plan view of an example of the shape of a heater and the arrangement of electrodes of the ink ejecting unit shown in FIG. 4.

FIG. 5 illustrates a plan view of an example of the shape of a heater and the arrangement of electrodes of the ink ejecting unit shown in FIG. 4. Referring to FIG. 5, the electrodes 160 are connected to the heater 130, having a ring shape, opposite to each other. That is, the heater 130 is connected in parallel between the electrodes 160.

Figure 6:
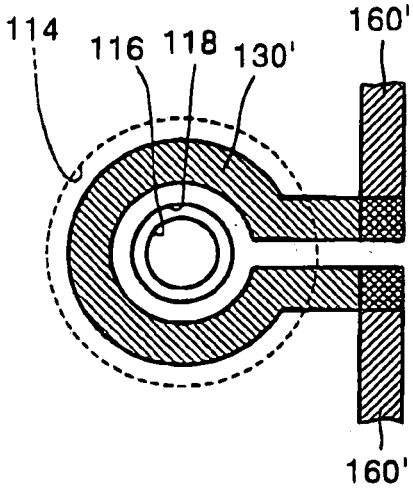
FIG. 6 illustrates a plan view of another example of the shape of a heater and the arrangement of electrodes of the ink ejecting unit shown in FIG. 4.

FIG. 6 illustrates a plan view illustrating another example of the shape of a heater and the arrangement of electrodes of the ink ejecting unit shown in FIG. 4. Referring to FIG. 6, a heater 130' is formed near in shape to a Greek letter omega and surrounds the nozzle 118. The electrodes 160' are respectively connected to both ends of the heater 130'. That is, the heater 130' shown in FIG. 6 is connected in series between the electrodes 160'.

Referring back to FIG. 4, a second passivation layer 170 is formed on the electrodes 160 to protect the electrodes 160. Preferably, a tetraethylorthosilicate (TEOS) oxide layer is used as the second passivation layer 170. The second passivation layer 170 may be formed of three layers, such as oxide-nitride-oxide (ONO).

A coating layer 180 having a hydrophobic property and good durability, may be coated on the outermost surface of the ink ejecting unit, that is, the surface of the second passivation layer 170 for protecting the electrodes 160.

In a bubble-jet type ink-jet printhead, ink is ejected in a droplet form, and thus the ink should be stably ejected in a complete droplet form to obtain a high printing performance. Thus, in general, a hydrophobic coating layer is coated on the surface of the printhead, so that the ink is ejected in a complete droplet form, and a meniscus formed on an outlet of the nozzle after the ink is ejected is quickly stabilized. Also, the hydrophobic coating layer may prevent the nozzle from being contaminated due to ink or a foreign material stained on the surface around the nozzle, and thus ink ejection can travel in a straight direction. The surface of the ink-jet print head is continuously exposed to the ink in a high temperature state, and scratching or dimpling due to wiping to remove residual ink may occur. Therefore, the ink-jet printhead should have a high durability, i.e., be corrosion-resistant or abrasion-resistant.

A metal, such as gold (Au), palladium (Pd), or tantalum (Ta), or a high molecular substance, such as Teflon, which is a type of heat-resistant resin, has been used as a conventional material for the coating layer. However, while these metals have high durability they do not have a high hydrophobic property. A high molecular substance, such as Teflon, has a high hydrophobic property but low durability.

Thus, in the printhead according to the present invention, diamond-like carbon (DLC) having a high hydrophobic property and high durability is preferably used as the material for the coating layer 180. The DLC has a structure in which carbon atoms are combined in the shape of $SP^2$ and $SP^3$ molecular combinations. As a result, the DLC has the traditional characteristics of diamond and a property of graphite due to $SP^2$ molecular combination. Thus, the DLC coating layer 180 has a high hydrophobic property and is highly abrasion-resistant and corrosion-resistant, even at a thickness of about 0.1 μm.

Figure 7:
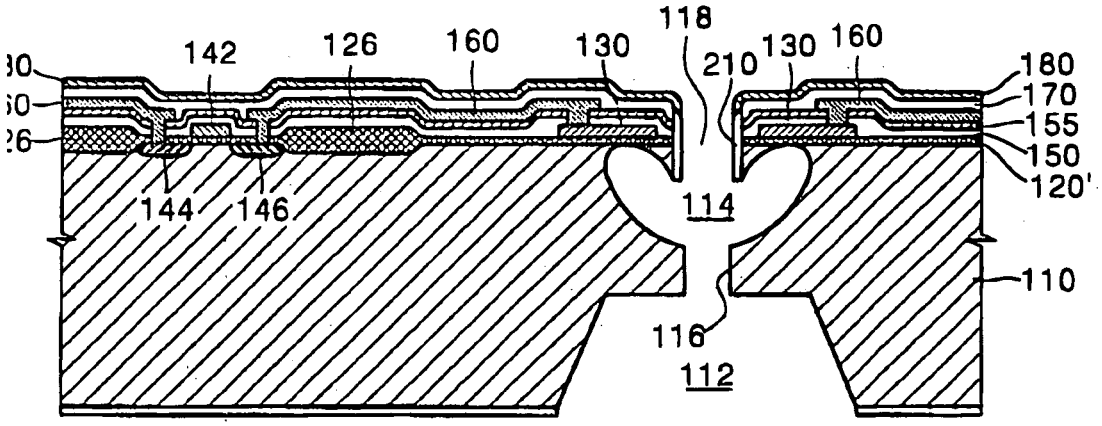
FIG. 7 illustrates a cross-sectional view of the vertical structure of an ink ejecting unit according to a second embodiment of the present invention.

FIG. 7 illustrates a cross-sectional view of the vertical structure of an ink ejecting unit according to a second embodiment of the present invention. The second embodiment is similar to the first embodiment except for a nozzle guide formed on an upper portion of the ink chamber 114, a difference that will be more fully described below.

In the ink ejecting unit shown in FIG. 7, the bottom of the ink chamber 114 has a nearly hemispheric shape, like in the first embodiment, but a nozzle guide 210, which is extended in a direction of the depth of the ink chamber 114 from the edges of the nozzle 118, is formed on an upper portion of the ink chamber 114. The nozzle guide 210 guides ejected ink droplets so that the ink droplets are ejected perpendicular to the substrate 110.

In the printhead according to the present invention, printhead elements and a MOS integrated circuit are formed monolithically on the silicon substrate 110, and the DLC coating layer 180 having a high hydrophobic property and high durability may be formed on the outermost (i.e., external) surface of the silicon substrate 110. In addition, the heater 130 and the electrodes 160 of the printhead according to the present invention have the same shape, arrangement, and connection shape as those of the heater 130 and the electrodes 160 shown in either FIG. 5 or FIG. 6.

Hereinafter, an ink droplet ejection mechanism of the monolithic ink-jet printhead according to the present invention having the above structure will be described.

Figure 8A:
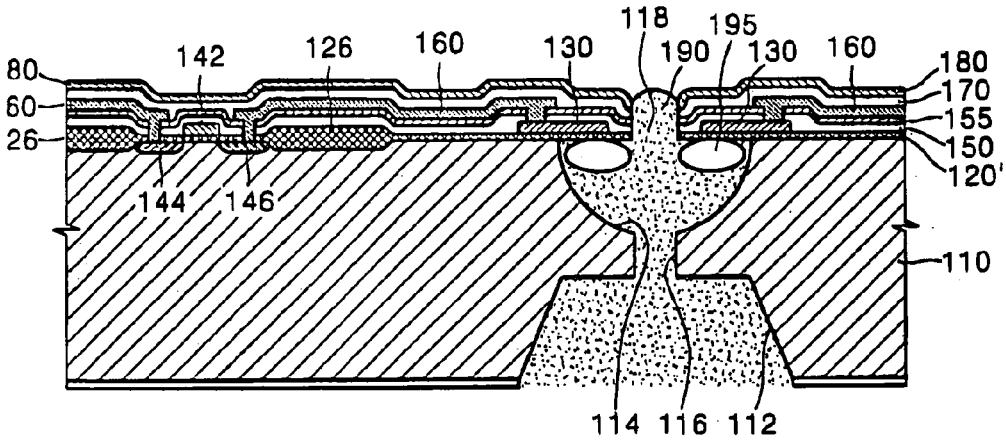
FIGS. 8A and 8B illustrate cross-sectional views of the mechanism in which ink is ejected from the ink ejecting unit shown in FIG. 4.
Figure 8B:
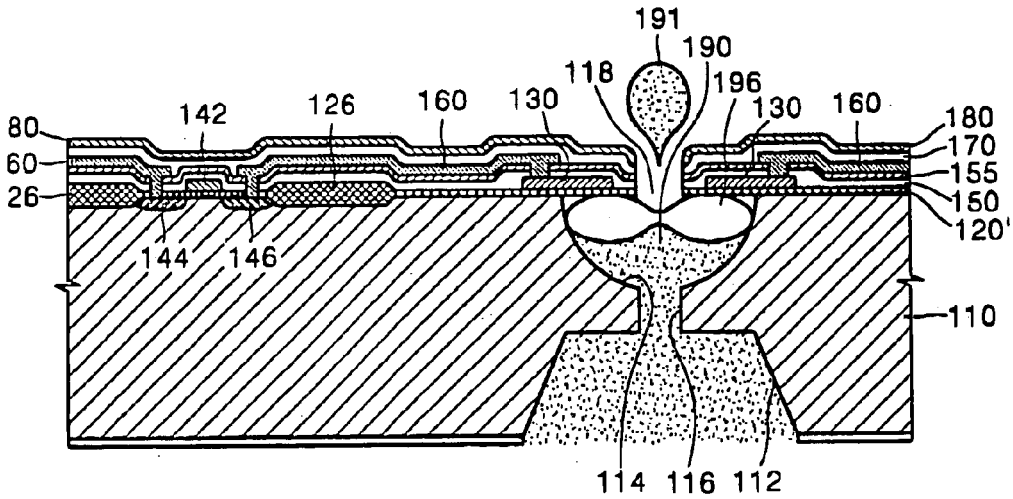

FIGS. 8A and 8B illustrate cross-sectional views of the mechanism in which ink is ejected from the ink ejecting unit shown in FIG. 4. Referring to FIG. 8A, ink 190 is supplied into the ink chamber 114 through the ink supply manifold 112 and the ink channel 116 due to a capillary action. In a state where the ink chamber 114 is filled with the ink 190, heat is generated by the heater 130 when pulse current is applied to the heater 130 by the MOS integrated circuit. The generated heat is transferred to the ink 190 in the ink chamber 114 through the oxide layer 120' under the heater 130. Thus, the ink 190 boils, and bubbles 195 are generated. The shape of the bubbles 195, a nearly doughnut shape, is according to the shape of the heater 130.

As the bubbles 195 having a doughnut shape swell, as shown in FIG. 8B, the bubbles 195 grow into bubbles 196 having a nearly disc shape, in which the bubbles 195 coalesce under the nozzle 118 and a hollow center is formed. Simultaneously, ink droplets 191 are ejected by the swollen bubbles 196 from the ink chamber 114 through the nozzle 118.

If the applied current is cut off, the heater 130 cools, and the bubbles 196 contract, or the bubbles 196 break, and the ink chamber 114 refills with ink 190.

In the ink ejection mechanism of the printhead according to the present invention, the bubbles 195 having a doughnut shape coalesce, and the bubbles 196 having a disc shape are formed, so that a tail of the ejected ink droplets 191 is cut, thereby preventing the formation of satellite droplets. As the swelling of the bubbles 195 and 196 takes place in the ink chamber 114 having a hemispheric shape, the back flow of the ink 190 is suppressed, and cross-talk between adjacent another ink ejecting units is also suppressed. Further, in a preferred embodiment where the diameter of the ink channel 116 is smaller than that of the nozzle 118, the back flow of the ink 190 may be even more effectively prevented.

Since the heater 130 has a ring shape or Greek letter omega shape of a wide area, heating and cooling are performed quickly, and thus the time elapsed from the formation of the bubbles 195 and 196 to the extinction of the bubbles 195 and 196 is shortened, thereby a quick printing response and a high printing driving frequency may be acquired. Since the shape of the ink chamber 114 is hemispheric, the swelling path of the bubbles 195 and 196 is more stable as compared to a conventional ink chamber having a rectangular or pyramid shape. Thus, the formation and swelling of the bubbles 195 and 196 are performed more quickly, and thus the ink is ejected within a shorter time.

In particular, the coating layer 180 having a high hydrophobic property and durability is coated on the outermost surface of the ink ejecting unit, the ink droplets 191 are formed stably and are definitely ejected, and thus the contamination of the surface around the nozzle 118 is prevented. In addition, even a thin coating layer 180 has high durability, and thus the life span of the printhead may be increased.

Figure 9A:
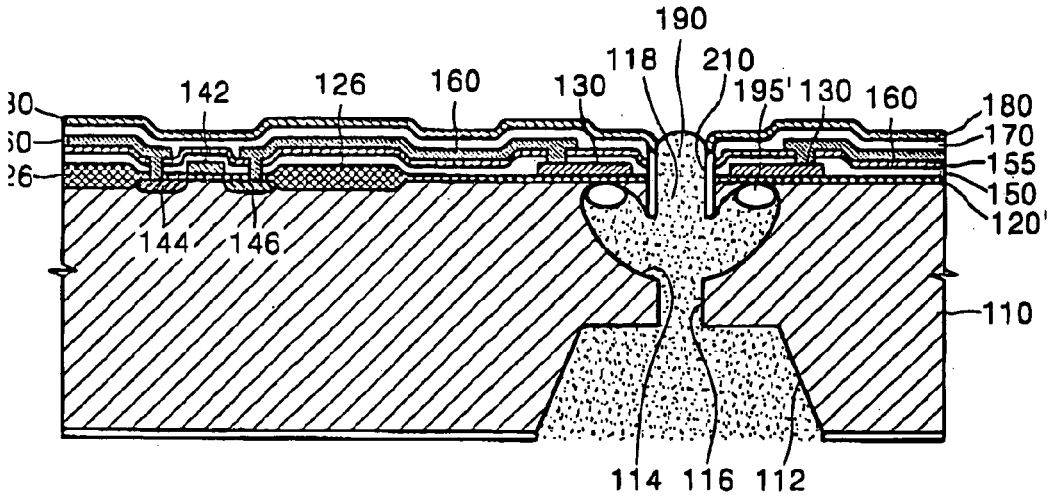
FIGS. 9A and 9B illustrate cross-sectional views of the mechanism in which ink is ejected from the ink ejecting unit shown in FIG. 7.
Figure 9B:
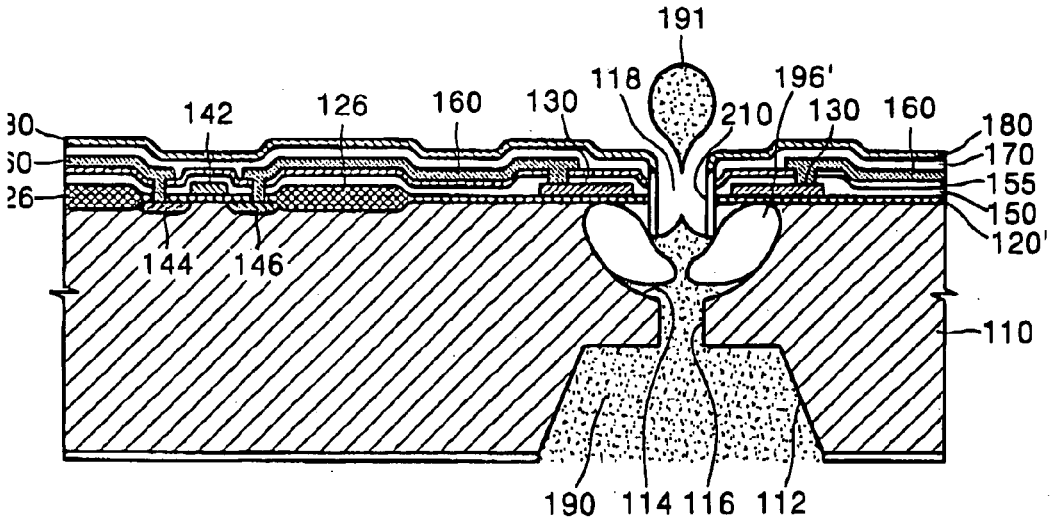

FIGS. 9A and 9B illustrate cross-sectional views of the mechanism in which ink is ejected from the ink ejecting unit shown in FIG. 7. The mechanism shown in FIG. 9A is similar to the ink droplet ejection mechanism in the first embodiment, and thus only the distinctions will now be described. Referring to FIG. 9A, when the ink 190 is supplied into the ink chamber 114, and the ink chamber is filled with the ink 190, pulse current is applied to the heater 130 by the MOS integrated circuit. Due to the generated heat, the ink 190 boils, and bubbles 195' having a nearly doughnut shape are generated. As in the first embodiment, the doughnut-shaped bubbles 195' swell and coalesce.

As shown in FIG. 9B, a nozzle guide 210 is formed in the ink ejecting unit according to the second embodiment, and thus the bubbles 195' do not coalesce directly under the nozzle 118. However, the location that the swollen bubbles 196 coalesce in the ink chamber 114, below the nozzle 118, may be controlled by adjusting a length of the nozzle guide 210. In particular, according to the second embodiment, the ejection orientation of the ink droplet 191 ejected by the swollen bubbles 196' is guided by the nozzle guide 210, and thus the ink droplet 191 is ejected in a direction perpendicular to the substrate 110.

Hereinafter, a method for manufacturing a monolithic ink-jet printhead according to the present invention will be described.

Figure 10:
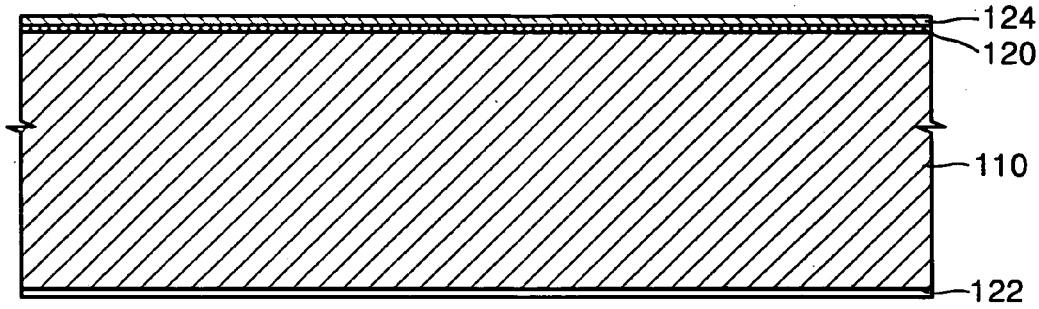
FIGS. 10 through 19 illustrate cross-sectional views of stages in a manufacturing process of a printhead having the ink ejecting unit according to the first embodiment of the present invention shown in FIG. 4.

FIGS. 10 through 19 illustrate cross-sectional views of stages in a manufacturing process of a printhead having the ink ejecting unit according to the first embodiment of the present invention, as shown in FIG. 4. Referring to FIG. 10, a silicon wafer having a crystal orientation of [100] and a thickness of about 500 μm is used as the substrate 110. A silicon wafer is selected because silicon wafers are widely used in manufacturing semiconductor devices and may be used without change, thereby facilitating mass-production. When the silicon substrate 110 is put in an oxidation furnace and wet or dry oxidized, the top and bottom surfaces of the substrate 110 are oxidized, thereby silicon oxide layers 120 and 122 each having a thickness of about 480 Å are formed.

Only a representative portion of the silicon wafer is shown in FIG. 10, and a printhead according to the present invention is manufactured of several tens through hundreds of chips from one wafer. In addition, the silicon oxide layers 120 and 122 are formed on both top and bottom surfaces of the substrate 110. Two silicon oxide layers 120 and 122 are formed because a batch-type oxidation furnace, in which the bottom surface of the silicon wafer is also exposed to an oxidation atmosphere, is used. However, in a case that a single wafer type oxidation furnace, in which only the top surface of the silicon wafer is exposed to an oxidation atmosphere, is used, the silicon oxide layer 122 is not formed on the bottom surface of the silicon wafer. The case when a predetermined material layer is formed only on one surface of the silicon wafer is sufficiently similar to the case when a material layer is formed on both top and bottom surfaces of the silicon wafer, as presented in FIG. 11 through FIG. 19. Hereinafter, only for explanatory reasons, further material layers (e.g., a silicon nitride layer, a polysilicon layer, and a TEOS oxide layer, which are described later) are described as only having been formed only on a top surface of the substrate 110. In connection with the explanation of the manufacturing process of the printhead silicon oxide layer 120 will be referred to as a first silicon oxide layer 120 to distinguish from subsequently formed silicon oxide layers.

Subsequently, a silicon nitride layer 124 is deposited on the surface of the first silicon oxide layer 120. The silicon nitride layer 124 may be deposited to a thickness of about 1000 Å by low pressure chemical vapor deposition (LPCVD). The silicon nitride layer 124 is used as a mask when a field oxide layer (126 in FIG. 11) is formed.

Figure 11:
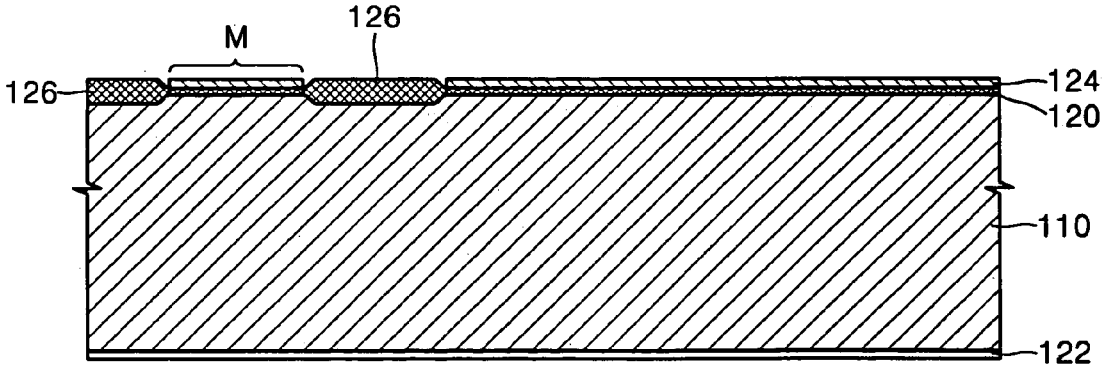

FIG. 11 illustrates a stage where a portion of the first silicon oxide layer 120 and the silicon nitride layer 124 that are formed on the substrate 110 is etched, and a field oxide layer 126 is formed in the etched portion of the first silicon oxide layer 120 and the silicon nitride layer 124. Specifically, the silicon nitride layer 124 and the first silicon oxide layer 120, which are formed around a region M on which a MOSFET, which will be described later, is to be formed, are etched using a photoresist (PR) pattern as an etch mask. Subsequently, the surface of the substrate 110 exposed by the above etching process is oxidized in the oxidation furnace, thereby forming the field oxide layer 126 to a thickness of 7000 Å, on the surface of the substrate 100. The field oxide layer 126 serves as an insulating layer for insulating MOSFETs from one another and is formed to surround a MOSFET region M.

Although the field oxide layer 126 shown in FIG. 11 is formed only around the MOSFET region M, the field oxide layer 126 may be formed on the entire surface of the substrate 110, except over the MOSFET region M. In the latter case, the silicon nitride layer 124 and the first silicon oxide layer 120 other than the MOSFET region M are etched, and then, a thicker field oxide layer 126 is formed on the entire surface of the substrate 110 exposed by this etching. However, in the former case, as will be described later, a second silicon oxide layer (120' of FIG. 13) under the heater (130 of FIG. 13) may be formed to be thinner. Accordingly, heat generated by the heater 130 may be more effectively and more quickly transferred to the ink filled in the ink chamber under the heater 130.

Figure 12:
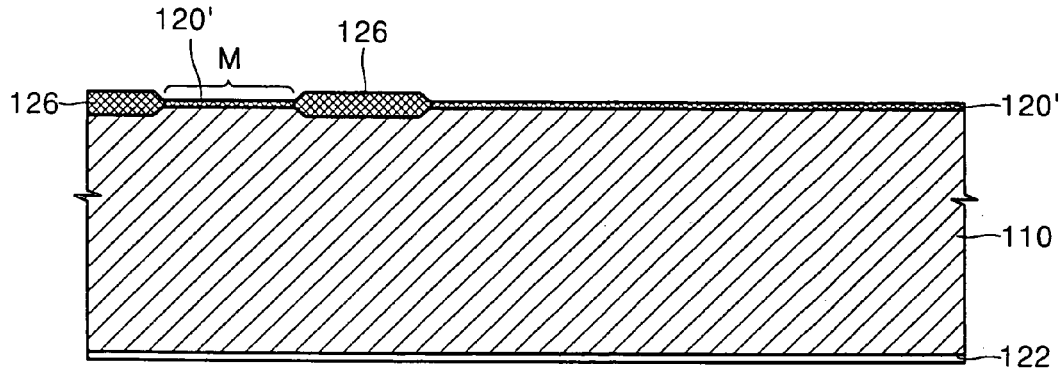

FIG. 12 illustrates a stage where a second silicon oxide layer 120' is formed on one surface of the substrate 110 on which the field oxide layer 126 is formed. Specifically, after the field oxide layer 126 is formed, the first silicon oxide layer 120 and the silicon nitride layer 124 on the surface of the substrate 110 are removed by etching. Subsequently, a second silicon oxide layer 120' having a thickness of about 630 Å is formed on the surface of the substrate 110 in the oxidation furnace. The second silicon oxide layer 120' serves as a gate oxide layer of a MOSFET in the MOSFET region M, and serves as a heater insulating layer in another region, in which the heater is formed.

Although not shown, a sacrificial oxide layer may be formed and removed, before the second silicon oxide layer 120' is formed on the surface of the substrate 110 and after the first silicon oxide layer 120 and the silicon nitride layer 124 on the surface of the substrate 110 are removed by etching. The sacrificial oxide layer may be formed and removed in order to remove foreign substances attached to the surface of the substrate 110 in the above-mentioned steps.

In addition, doping boron (B) on the second silicon oxide layer 120' in the MOSFET region M may be performed in order to control a threshold voltage after the second silicon oxide layer 120' is formed.

Figure 13:
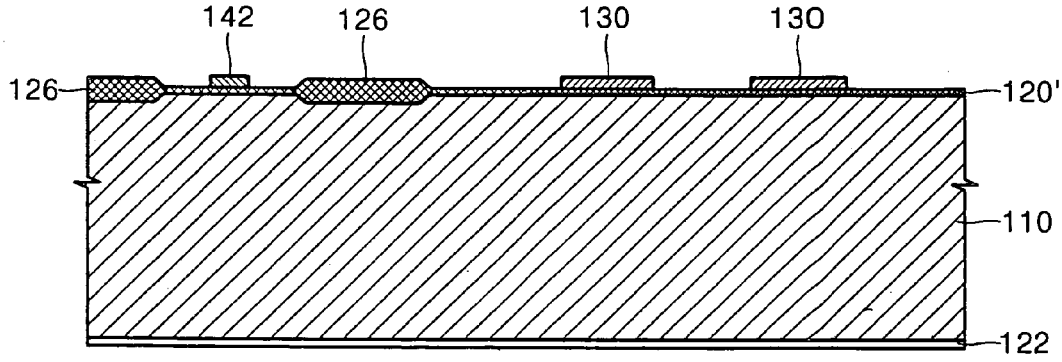

FIG. 13 illustrates a stage where the heater 130 and the gate 142 of the MOSFET are formed on the second silicon oxide layer 120'. The heater 130 and the gate 142 are formed by depositing an impurity-doped polysilicon layer on the entire surface of the second silicon oxide layer 120' and patterning the impurity-doped polysilicon layer. Specifically, the impurity-doped polysilicon layer is deposited with a source gas of phosphorous (P) on the entire surface of the second silicon oxide layer 120' through LPCVD, thereby the impurity-doped polysilicon layer is formed to a thickness of about 5000 Å. The deposition thickness of the polysilicon layer may vary to have proper resistance in consideration of the width and the length of the heater 130. The polysilicon layer deposited on the entire surface of the second silicon oxide layer 120' is patterned by a photolithographic process, using a photomask and photoresist, and by an etching process, using a photoresist pattern as an etching mask.

Although the heater 130 and the gate 142 may be simultaneously formed of same material, the heater 130 may also be formed of a material different from that of the gate 142, for example, an alloy of tantalum and aluminum. In the latter case, a photolithographic process and an etching process for forming the heater 130 and the gate 142, respectively, are performed separately.

Figure 14:
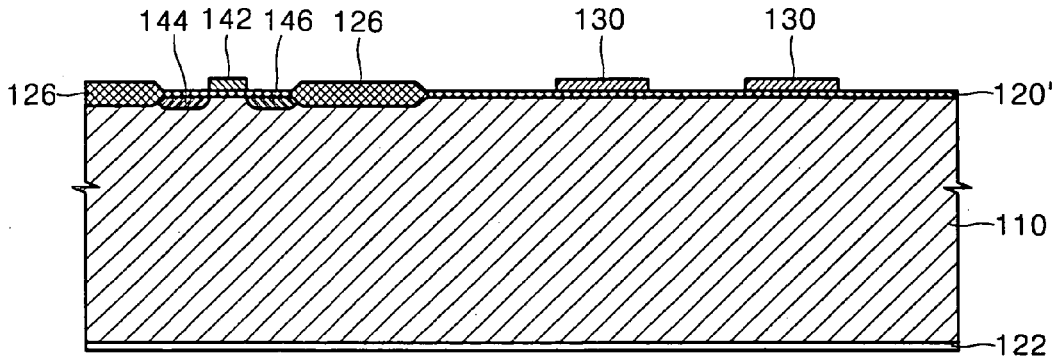

FIG. 14 illustrates a stage where the source region 144 and the drain region 146 of the MOSFET are formed in the MOSFET region M. The source region 144 and the drain region 146 of the MOSFET may be formed by doping phosphorous (P), which is an impurity, on a substrate 110. As a result, a MOSFET including the gate 142, formed on the gate oxide layer (i.e., the second silicon oxide layer) 120', and the source region 144 and the drain region 146, formed under the gate oxide layer 120', is formed.

Figure 15:
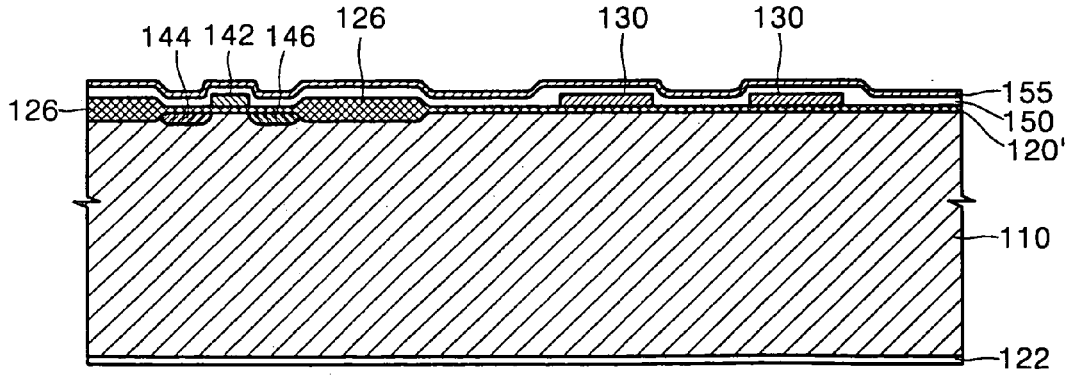

FIG. 15 illustrates a stage where the first passivation layer 150 and the BPSG layer 155 are formed on the MOSFET and on the heater 130. The first passivation layer 150 protects the heater 130 and the gate 14, and may be formed by depositing through a chemical vapor deposition (CVD) a silicon nitride layer to a thickness of about 0.3 μm. The BPSG layer 155 may be coated on the first passivation layer 150 to a thickness of about 0.2 μm using a spin coater in order to planarize the surface of the ink ejecting unit.

Although not shown, a TEOS oxide layer may be deposited as an insulating layer before the silicon nitride layer is deposited as the first passivation layer 150. The TEOS layer may be formed to a thickness of about 0.2 μm through plasma enhanced chemical vapor deposition (PECVD). In this case, three layers, such as the TEOS oxide layer, the silicon nitride layer 150, and the BPSG layer 155, may be on the heater 130 and the gate 142.

Figure 16:
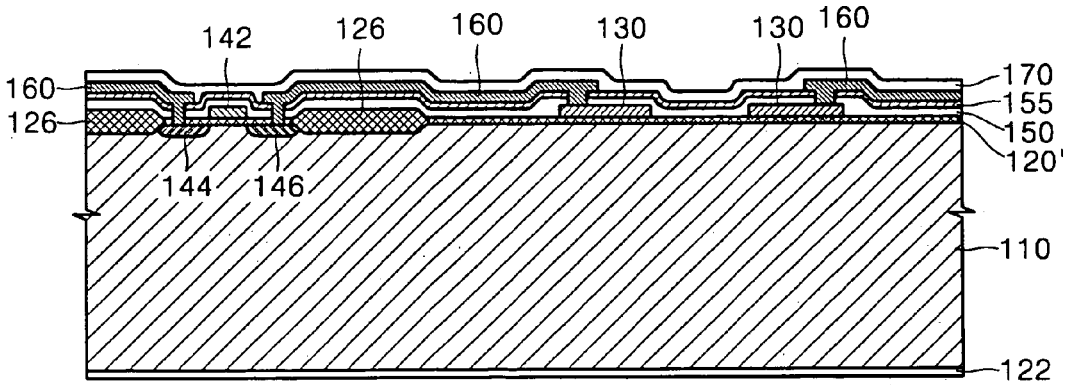

FIG. 16 illustrates a stage where the electrodes 160 are formed on the substrate 110, and the second passivation layer 170 is formed on the electrodes 160. Specifically, aluminum or an aluminum alloy, having good conductivity, which can be easily patterned, is deposited to a thickness of about 1 μm through sputtering, and is patterned after a contact hole connected to the heater 130 and to the source region 144 and the drain region 146 of the MOSFET is formed by etching the first passivation layer 150 and the BPSG layer 155, thereby forming the electrodes 160.

Subsequently, the TEOS oxide layer is deposited as the second passivation layer 170, for protecting the electrodes 160, on the entire surface of the substrate 110 on which the electrodes 160 are formed. The second passivation layer 170 may be formed to a thickness of about 0.7 μm through PECVD. The passivation layer for the electrodes 160 may be formed of three layers by sequentially depositing an oxide layer, an nitride layer, and an oxide layer.

Figure 17:
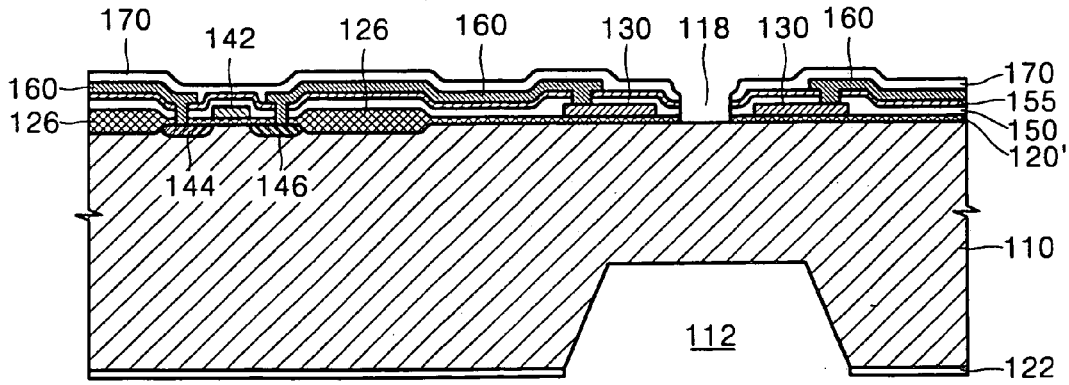

FIG. 17 illustrates a stage where the nozzle 118 and the ink supply manifold 112 are formed. Specifically, the second passivation layer 170, the BPSG layer 155, the first passivation layer 150, and the second silicon oxide layer 120' are sequentially etched to a diameter smaller than that of the heater 130, i.e., between about 16-20 μm, thereby forming the nozzle 118 inside the heater 130. The nozzle 118 may be formed by a photolithographic process, using a photomask and photoresist, and by an etching process, using a photoresist pattern as an etching mask.

Subsequently, the ink supply manifold 112 is formed by slantingly etching the bottom surface of the substrate 110. Specifically, in case that an etching mask for defining a region to be etched on the bottom surface of the substrate 110 is formed, and the ink supply manifold 112 is wet-etched for a predetermined amount of time using tetramethyl ammonium hydroxide (TMAH) as an etchant. Etching in the orientation [111] becomes slower than in other orientations, thereby forming an ink supply manifold 112 having a slope of about 54.7°.

Although the ink supply manifold 112 is formed after the nozzle 118 is formed in FIG. 17, the ink supply manifold 112 may be formed in the previous step. In addition, although the ink supply manifold 112 is formed by slantingly etching the bottom surface of the substrate 110, the ink supply manifold 112 may be formed by anisotropic etching.

Figure 18:
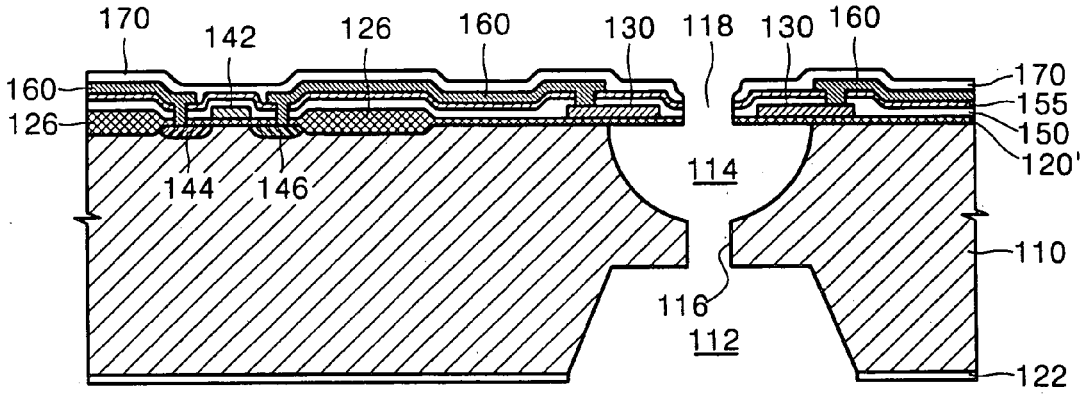

FIG. 18 illustrates a stage where the ink chamber 114 and the ink channel 116 are formed. Specifically, the ink chamber 114 may be formed by isotropically etching the substrate 110 exposed by the nozzle 118. Specifically, the substrate 110 is dry-etched for a predetermined amount of time using a $XeF_2$ gas or a $BrF_3$ gas as an etching gas. As shown in FIG. 18, the ink chamber 114, having a depth and radius of about 20 μm and having an approximately hemispheric shape, is formed.

The ink chamber 114 may be formed in two steps, first by anisotropically etching the substrate 110 and subsequently, by isotropically etching the substrate 110. That is, the silicon substrate 110 is anisotropically etched through inductively coupled plasma etching (ICPE) or reactive ion etching (RIE), thereby a hole (not shown) is formed to a predetermined depth. Subsequently, the silicon substrate 110 is isotropically etched in the same way. Alternatively, the ink chamber 114 may be formed by changing a region of the substrate 110, in which the ink chamber 114 is formed, into a porous silicon layer, and by selectively etching and removing the porous silicon layer.

Subsequently, the ink channel 116 for connecting the ink chamber 114 to the ink supply manifold 112 is formed by anisotropically etching the substrate 110 on the bottom of the ink chamber 114. In this case, the diameter of the ink channel 116 is the same as or smaller than that of the nozzle 118. In particular, in a case where the diameter of the ink channel 116 is smaller than that of the nozzle 118, the back flow of the ink may be more effectively prevented, and thus the diameter of the ink channel 116 needs to be finely adjusted.

Figure 19:
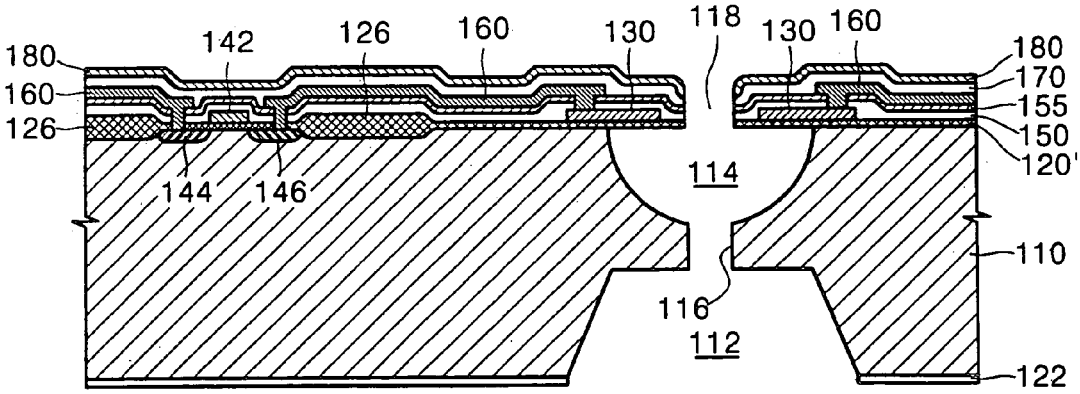

FIG. 19 illustrates a stage where a printhead according to the present invention is completed by forming the coating layer 180 on the outermost surface of the ink ejecting unit. Here, as previously described, DLC having a high hydrophobic property and high durability, i.e., is abrasion-resistant and corrosion-resistant, is preferably used as a material of the coating layer 180. The DLC coating layer 180 may be formed to a thickness of about 0.1 μm through CVD or sputtering.

FIGS. 20 through 23 illustrate cross-sectional views of stages in a manufacturing process of a printhead having an ink ejecting unit according to the second embodiment of the present invention shown in FIG. 7.

The method for manufacturing a printhead having the ink ejecting unit shown in FIG. 7 is similar to the method for manufacturing a printhead having the ink ejecting unit shown in FIG. 4, except formation of the nozzle guide (210 of FIG. 7) is further included. That is, the method for manufacturing a printhead having the ink ejecting unit shown in FIG. 7 is initially the same as the stages shown in FIGS. 10-16. Subsequent steps are illustrated in FIGS. 20-23 and include the formation of the nozzle guide. Hereinafter, the method for manufacturing a printhead having the ink ejecting unit shown in FIG. 7 will be described to explain the above-described difference.

Figure 20:
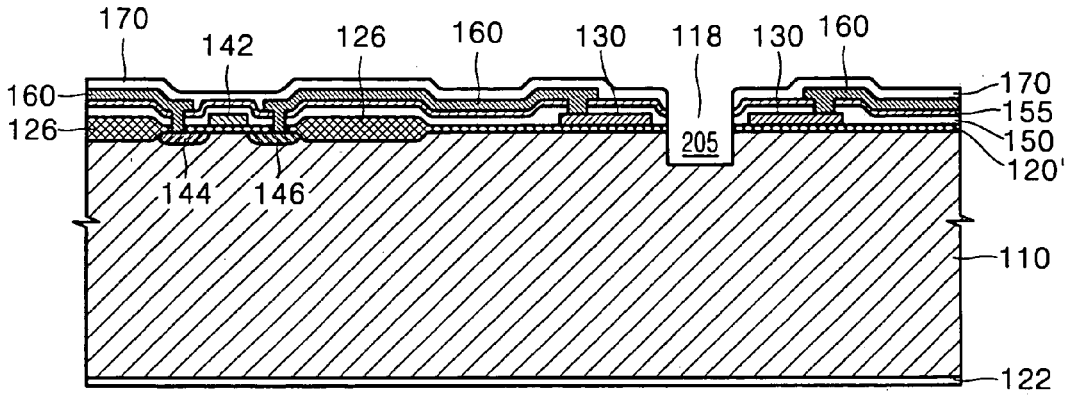
FIGS. 20 through 23 illustrate cross-sectional views of stages in a manufacturing process of a printhead having the ink ejecting unit according to the second embodiment of the present invention shown in FIG. 7.

As shown in FIG. 20, after the stage shown in FIG. 16, the second passivation layer 170, the BPSG layer 155, the first passivation layer 150, and the second silicon oxide layer 120' are sequentially etched to a diameter smaller than the diameter of the heater 130, i.e., between about 16-20 μm, thereby forming the nozzle 118. Subsequently, the substrate 110 exposed by the nozzle 118 is anisotropcially etched, thereby forming a hole 205 having a predetermined depth. The nozzle 118 and the hole 205 may be formed through a photolithographic process, using a photomask and photoresist and an etching process, using a photoresist pattern as an etching mask.

Figure 21:
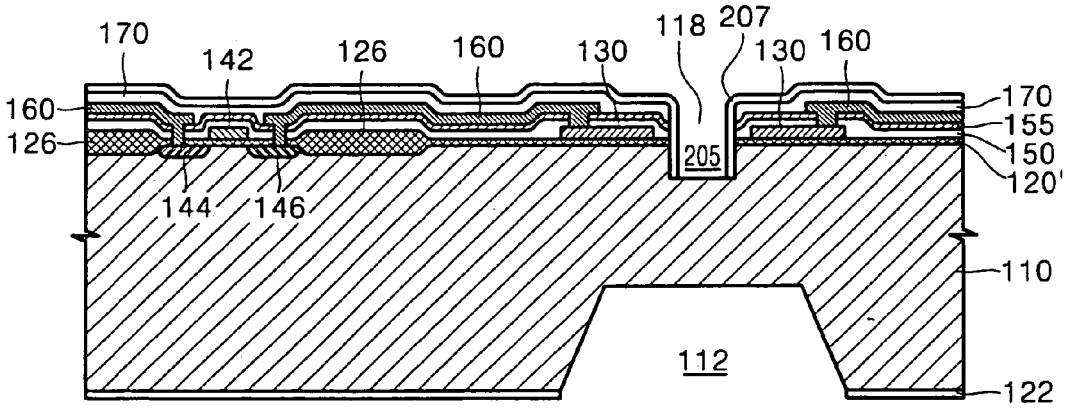

Subsequently, as shown in FIG. 21, a predetermined material layer, i.e., a TEOS oxide layer 207, is deposited to a thickness of about 1 μm on the entire surface of the ink ejecting unit. Subsequently, the bottom surface of the substrate 110 is slantingly etched, thereby forming the ink supply manifold 112. The method and steps for forming the ink supply manifold 112 are the same as described above in connection with the first embodiment.

Figure 22:
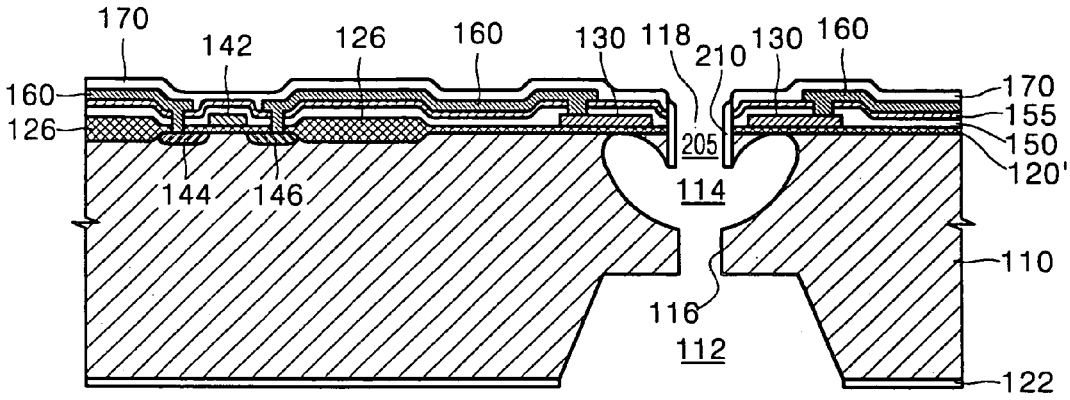

Subsequently, the TEOS oxide layer 207 is anisotropically etched until the substrate 110 is exposed, thereby forming the nozzle guide 210 on the sidewall of the hole 205, as shown in FIG. 22. In this stage, the substrate 110 exposed to the bottom surface of the hole 205 is etched, thereby forming the ink chamber 114 and the ink channel 116.

Although not shown, steps of depositing an additional oxide layer on the inner circumference of the nozzle guide 210 may be performed after the nozzle guide 210 is formed. The oxide layer enhances the nozzle guide 210 by increasing the thickness of the nozzle guide 210 and may be deposited through PECVD.

Figure 23:
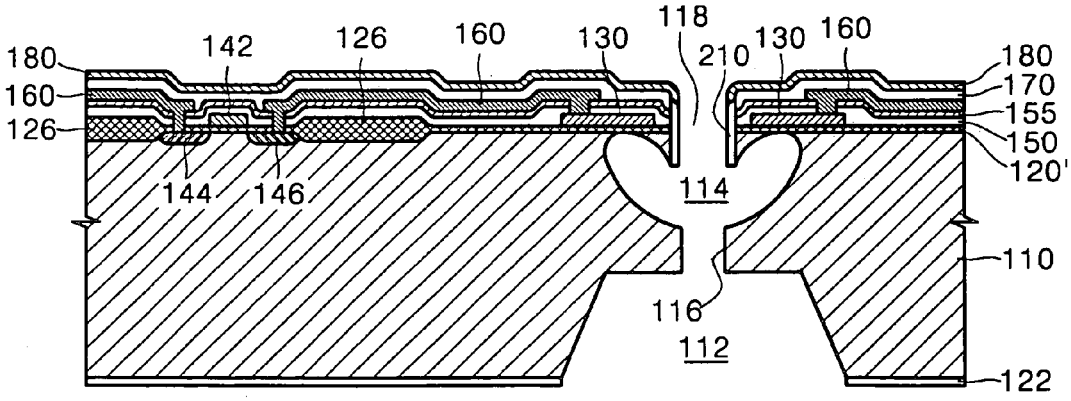

In a case where the DLC coating layer 180 is formed on the outermost surface of the ink ejecting unit in the above manner, as shown in FIG. 23, the printhead, in which the nozzle guide 210 forming the inner wall of the nozzle 118 is formed on an upper portion of the ink chamber 114, is completed.

As described above, a monolithic ink-jet printhead in a bubble-jet mode according to the present invention has the following advantages. First, elements such as the ink supply manifold, the ink chamber, the ink channel, and the heater, and the MOS integrated circuit are formed monolithically on a substrate, thereby eliminating the difficulties of a prior art process in which the nozzle plate and the substrate are separately manufactured, bonded, and aligned. In addition, since a silicon wafer is used as the substrate, the substrate may be used even in a conventional semiconductor device manufacturing process, thereby facilitating mass-production.

Second, the DLC coating layer formed on the external surface of the ink ejecting unit has a high hydrophobic property and high durability, and thus more stable and definite ejection of ink droplets may be achieved. Accordingly, the reliability, printing quality, and life span of the ink-jet printhead may be improved.

Third, since the bubbles have a doughnut shape, and the ink chamber has a hemispheric shape, the back flow of the ink, cross-talk with another ink ejecting unit, and satellite droplets may be avoided.

Preferred embodiments of the present invention have been disclosed herein and, although specific terms are employed, they are used and are to be interpreted in a generic and descriptive sense only and not for purpose of limitation. For example, alternate materials may be used as materials for use in elements of the printhead according to the present invention. That is, the substrate may be formed of another material having a good processing property, as well as silicon, and the same applies to the heater, electrodes, the silicon oxide layer, and the silicon nitride layer. In addition, the described method for stacking and forming materials is only for explanatory reasons, and various deposition and etching methods may be used. Moreover, the order of steps in the method for manufacturing the printhead according to the present invention may be changed. For example, the step of etching the bottom surface of the substrate for forming the ink supply manifold may be performed in the step shown in FIG. 17 as well as before or after the step shown in FIG. 17. Further, specific values illustrated in steps may be adjusted within the scope in which the printhead can operate normally, although out of the scope illustrated in the present invention. Accordingly, it will be understood by those of ordinary skill in the art that various changes in form and details may be made without departing from the spirit and scope of the present invention as set forth in the following claims.

What is claimed is:

1. A method for manufacturing a monolithic ink-jet printhead, comprising:

preparing a silicon substrate;

forming a first silicon oxide layer by oxidizing the surface of the substrate;

forming, on the substrate, a MOS integrated circuit including a MOSFET for driving the heater and electrodes connected to the heater;

forming a heater on a second silicon oxide layer;

forming, inside the heater, a nozzle for ejecting ink by etching a hole in the second silicon oxide layer, the hole having a diameter smaller than an innermost diameter of the heater;

forming a manifold for supplying ink by etching a bottom surface of the substrate;

forming an ink chamber having a diameter larger than that of the heater and having a hemispheric shape by etching the substrate exposed by the nozzle; and forming an ink channel for connecting the ink chamber to the manifold by etching the bottom of the ink chamber through the nozzle.

2. The method as claimed in claim 1, wherein the heater has a ring shape.

3. The method as claimed in claim 1, wherein the heater has a shape of a Greek letter omega.

4. The method as claimed in claim 1, after forming the ink channel, further comprising coating a coating layer formed of diamond-like carbon (DLC) on an external surface of the printhead.

5. The method as claimed in claim 4, wherein the coating layer formed of diamond-like carbon (DLC) is formed to a thickness of about 0.1 μm through CVD or sputtering.

6. The method as claimed in claim 1, wherein a first passivation layer is formed on the heater and on the MOSFET, the electrodes are formed on the first passivation layer, and a second passivation layer is formed on the electrodes.

7. The method as claimed in claim 6, wherein the first passivation layer includes a first passivation silicon nitride layer, and the second passivation layer includes a tetraethylorthosilicate (TEOS) oxide layer.

8. The method as claimed in claim 7, wherein the first passivation silicon nitride layer is deposited by a chemical vapor deposition (CVD) to a thickness of about 0.3 μm.

9. The method as claimed in claim 6, wherein a boro-phosphorous-silicate glass (BPSG) layer is coated on the first passivation layer to planarize the surface of the printhead.

10. The method as claimed in claim 9, wherein the boro-phosphorous-silicate glass (BPSG) layer is coated to a thickness of about 0.2 μm using a spin coater.

11. The method as claimed in claim 6, wherein a TEOS oxide layer is deposited as an insulating layer before the first passivation layer is deposited.

12. The method as claimed in claim 6, wherein the second passivation layer is formed of three layers by sequentially depositing an oxide layer, a nitride layer, and an oxide layer.

13. The method as claimed in claim 1, wherein forming the ink chamber includes isotropically etching the substrate exposed by the nozzle.

14. The method as claimed in claim 13, wherein the isotropic etching includes dry-etching the substrate for a predetermined amount of time using a $XeF_2$ gas or a $BrF_3$ gas as an etching agent.

15. The method as claimed in claim 13, wherein forming the ink chamber includes forming a hole having a predetermined depth by anisotropically etching the substrate exposed by the nozzle, and then enlarging the hole by isotropically etching the substrate.

16. The method as claimed in claim 13, wherein forming the ink chamber comprises:

forming a hole having a predetermined depth by anisotropically etching the substrate exposed by the nozzle;

depositing a predetermined material layer to a predetermined thickness on the entire surface of the anisotropically-etched substrate;

exposing a bottom of the hole by anisotropically etching the material layer and simultaneously forming a nozzle guide, which is formed of the material layer, on the sidewall of the hole; and forming the ink chamber by isotropically etching the substrate exposed at the bottom of the hole.

17. The method as claimed in claim 16, wherein the material layer is a TEOS oxide layer.

18. The method as claimed in claim 16, further comprising:

depositing an oxide layer on an inner circumference of the nozzle guide.

19. The method as claimed in claim 1, wherein forming the ink chamber comprises:

changing a region of the substrate, in which the ink chamber is formed, into a porous silicon layer; and selectively etching and removing the porous silicon layer.

20. The method as claimed in claim 1, wherein in the step of forming an ink channel, a diameter of the ink channel is the same as or smaller than that of the nozzle.

21. The method as claimed in claim 1, wherein in the step of forming an ink chamber, etching is performed from the nozzle side.

22. The method as claimed in claim 1, wherein, in forming the ink channel, the ink chamber is placed in communication with the manifold by etching the bottom of the ink chamber through the nozzle.

23. A method for manufacturing a monolithic ink-jet printhead, comprising:

preparing a silicon substrate;

forming a first silicon oxide layer by oxidizing the surface of the substrate;

forming, on the substrate, a MOS integrated circuit including a MOSFET for driving the heater and electrodes connected to the heater;

forming a heater on a second silicon oxide layer;

forming, inside the heater, a nozzle for ejecting ink by etching the second silicon oxide layer to a diameter smaller than that of the heater;

forming a manifold for supplying ink by etching a bottom surface of the substrate;

forming an ink chamber having a diameter larger than that of the heater and having a hemispheric shape by etching the substrate exposed by the nozzle; and forming an ink channel for connecting the ink chamber to the manifold by etching the bottom of the ink chamber through the nozzle, wherein forming the MOS integrated circuit includes:

depositing a silicon nitride layer on the first silicon oxide layer;

etching a portion of the first silicon oxide layer and the silicon nitride layer;

forming a field oxide layer thicker than the first silicon oxide layer around a region in which the MOSFET is to be formed;

removing the first silicon oxide layer and the silicon nitride layer;

forming a second silicon oxide layer on the substrate;

forming a gate of the MOSFET on a gate oxide layer using the second silicon oxide layer as the gate oxide layer;

forming source and drain regions of the MOSFET under the second silicon oxide layer; and forming electrodes for electrically connecting the heater to the MOSFET.

24. The method as claimed in claim 23, further comprising:

forming a sacrificial oxide layer on the substrate after removing the first silicon oxide layer and the silicon nitride layer; and removing the sacrificial oxide layer to remove any foreign substances from the substrate.

25. The method as claimed in claim 23, before forming the gate, in order to control a threshold voltage, further comprising doping boron (B) on the second silicon oxide layer in the region in which the MOSFET is to be formed.

26. The method as claimed in claim 23, wherein the gate and the heater are simultaneously formed of the same material.

27. The method as claimed in claim 26, wherein an impurity-doped polysilicon layer is deposited on the second silicon oxide layer and is patterned, thereby forming the gate and the heater.

28. The method as claimed in claim 23, wherein the gate is formed of impurity-doped polysilicon, and the heater is formed of an alloy of tantalum and aluminum.

* * * * *